US008548356B2

(12) United States Patent
Rapkin et al.

(10) Patent No.: US 8,548,356 B2
(45) Date of Patent: Oct. 1, 2013

(54) ELECTROPHOTOGRAPHIC PRINTER WITH STATEFUL TONER BOTTLES

(75) Inventors: Alan Earl Rapkin, Pittsford, NY (US); Jeffrey Allan Pitas, Macedon, NY (US); Peter Steven Alexandrovich, Rochester, NY (US); Donald Saul Rimai, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 264 days.

(21) Appl. No.: 13/096,215

(22) Filed: Apr. 28, 2011

(65) Prior Publication Data

US 2012/0275826 A1 Nov. 1, 2012

(51) Int. Cl.
*G03G 15/08* (2006.01)

(52) U.S. Cl.
USPC ..... 399/120

(58) Field of Classification Search
USPC ..... 399/119, 120
See application file for complete search history.

(56) References Cited

U.S. PATENT DOCUMENTS

| | | | | |
|---|---|---|---|---|
| 5,153,617 | A * | 10/1992 | Salmon | 347/115 |
| 6,608,641 | B1 | 8/2003 | Alexandrovich et al. | |
| 7,120,379 | B2 | 10/2006 | Eck | |
| 2002/0168200 | A1 | 11/2002 | Stelter et al. | |
| 2003/0082427 | A1 | 5/2003 | Prasad et al. | |
| 2006/0133870 | A1 | 6/2006 | Ng | |
| 2008/0267642 | A1 * | 10/2008 | Hadano | 399/27 |
| 2009/0232548 | A1 * | 9/2009 | d'Entrecasteaux | 399/120 |

FOREIGN PATENT DOCUMENTS

| | | |
|---|---|---|
| EP | 0 738 940 | 4/1996 |

* cited by examiner

*Primary Examiner* — Walter L Lindsay, Jr.
*Assistant Examiner* — Frederick Wenderoth
(74) *Attorney, Agent, or Firm* — Christopher J. White

(57) ABSTRACT

An electrophotographic (EP) printer has two toner bottles. Each has a supply volume and a waste volume separated so that toner can pass from the waste volume to the supply volume, and has a status recorder with waste and supply states. An imaging member receives toner from the supply volume of a second toner bottle in a supply receptacle, and an imaging member applies the toner to a receiver to form a print image. A cleaning device removes toner from an imaging members and transporting the removed toner to the waste volume of a first toner bottle in a waste receptacle. A toggle changes the state of the status recorder of the first toner bottle in the waste receptacle to the supply state, so that the waste toner in the waste volume of the first toner bottle is made available to be used as supply toner in the supply receptacle.

10 Claims, 3 Drawing Sheets

ELECTROPHOTOGRAPHIC PRINTER WITH STATEFUL TONER BOTTLES

CROSS-REFERENCE TO RELATED APPLICATIONS

Reference is made to commonly assigned, co-pending U.S. patent application Ser. No. 12/872,244, filed Aug. 31, 2010, entitled "Apparatus for Collecting Electrophotographic Waste," by Jeffrey A. Pitas, et al., the disclosure of which is incorporated by reference herein.

FIELD OF THE INVENTION

This invention pertains to the field of electrophotographic printing and more particularly to reuse of waste toner from a printer.

BACKGROUND OF THE INVENTION

Electrophotography is a useful process for printing images on a receiver (or "imaging substrate"), such as a piece or sheet of paper or another planar medium, glass, fabric, metal, or other objects as will be described below. In this process, an electrostatic latent image is formed on a photoreceptor by uniformly charging the photoreceptor and then discharging selected areas of the uniform charge to yield an electrostatic charge pattern corresponding to the desired image (a "latent image").

After the latent image is formed, charged toner particles are brought into the vicinity of the photoreceptor and are attracted to the latent image to develop the latent image into a visible image. Note that the visible image may not be visible to the naked eye depending on the composition of the toner particles (e.g. clear toner).

After the latent image is developed into a visible image on the photoreceptor, a suitable receiver is brought into juxtaposition with the visible image. A suitable electric field is applied to transfer the toner particles of the visible image to the receiver to form the desired print image on the receiver. The imaging process is typically repeated many times with reusable photoreceptors.

The receiver is then removed from its operative association with the photoreceptor and subjected to heat or pressure to permanently fix ("fuse") the print image to the receiver. Plural print images, e.g. of separations of different colors, are overlaid on one receiver before fusing to form a multi-color print image on the receiver.

Dry toner is a powder and is supplied from supply bottles or other containers to the photoreceptor to develop the latent image into a visible image. However, toner particles can adhere to components of the printer other than the latent image on the photoreceptor. Moreover, some toner particles can remain on the photoreceptor even after transfer of the visible image to the receiver to form the print image. Toner that enters the printer but does not exit as part of a print image on a receiver is collected and discarded as waste toner.

EP 0 738 940 B1 to Hashimoto describes collecting waste toner in a waste containing box. When the waste toner box fills, it is removed and replaced with another one. One waste box is provided for all toners in the printer. In other embodiments, one waste box or bottle is provided per printing module (color channel). In these schemes, the waste toner is generally discarded. In some printers, the waste bottles themselves are also discarded. Discarding waste toner and bottles increases the total waste produced by the printer. It also adds another consumable to be ordered and stocked by the user of the printer, namely, empty bottles to receive the waste. Furthermore, the operator of the printer is required to replace waste bottles when they become full. This can happen at the same time as the emptying of toner supply bottles, or at different times; in the latter case, the operator's workload to service the printer is increased.

U.S. Patent Publication No. 20090232548 by d'Entrecasteaux describes a toner bottle with a fresh-toner compartment and a waste-toner compartment. Waste toner is returned to the bottle from the marking engine. Although this scheme does not require separate toner and waste bottles, when the bottle fills with waste it is either discarded, increasing waste, or returned for recycling, increasing handling effort.

SUMMARY OF THE INVENTION

Moreover, in the scheme of d'Entrecasteaux, toner bottles full of fresh toner ("full bottles") and toner bottles full of waste toner ("empty bottles") are not readily distinguishable before they are installed in a printer. Therefore, there exists the possibility that an operator will accidentally install an empty bottle instead of a full bottle, increasing printer downtime for toner change.

Furthermore, waste toner can still be usable. That is, it is sometimes possible to reuse the waste toner. However, the schemes above separate the fresh toner and waste toner, preventing waste toner from being reused unless it is passed through a recycling process.

There is a continuing need, therefore, for a way of reducing the waste produced by a printer and the operator time required to handle the waste.

According to an aspect of the present invention, there is provided a dry electrophotographic (EP) printing apparatus, comprising:

a) first and second toner bottles, each including:

i) a supply volume and a waste volume separated by a separator that permits toner to pass from the waste volume to the supply volume; and ii) a status recorder adapted to retain state information about the respective toner bottle, the status recorder having waste and supply states;

b) a waste receptacle adapted to receive the first toner bottle in the waste state;

c) a supply receptacle adapted to receive the second toner bottle only in the supply state;

d) a printing module including:

i) one or more imaging members, wherein at least one of the imaging members is adapted to receive dry toner from the supply volume of the second toner bottle in the supply receptacle, and at least one of the imaging members is adapted to apply dry toner to a receiver to form a print image; and ii) a cleaning device for removing toner from at least one of the imaging members and transporting the removed toner to the waste volume of the first toner bottle in the waste receptacle; and e) a toggle for changing the state of the status recorder of the first toner bottle in the waste receptacle to the supply state, so that the waste toner in the waste volume of the first toner bottle is made available to be used as supply toner in the supply receptacle.

According to another aspect of the present invention, there is provided a method of re-using waste toner in a dry EP printer, comprising:

providing first and second toner bottles, each including:

a supply volume and a waste volume separated by a separator that permits toner to pass from the waste volume to the supply volume; and a status recorder adapted to retain state information about the respective toner bottle, the status recorder having waste and supply states;

wherein the first toner bottle is in the waste state and the second toner bottle is in the supply state;

inserting the first toner bottle in a waste receptacle;

inserting the second toner bottle in a supply receptacle;

providing toner from the supply volume of the second toner bottle in the supply receptacle to an imaging member in the printer, and applying the toner to a receiver to form a print image;

removing toner from at least one imaging member in the printer and transporting the removed toner to the waste volume of the first toner bottle in the waste receptacle;

changing the state of the status recorder of the first toner bottle in the waste receptacle to the supply state, and moving the first toner bottle to the supply receptacle, so that the waste toner in the waste volume of the first toner bottle is supplied to the printer from the supply receptacle.

An advantage of this invention is that it permits reuse of waste toner in the printer without requiring a service call or off-site recycling. Various embodiments reduce the probability of confusion between empty and full toner bottles. The probability of extended downtime due to such confusion is therefore reduced. Container waste is reduced since the same container is used for fresh toner and waste toner. The printer can be made with fewer parts, since no separate waste container is required.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
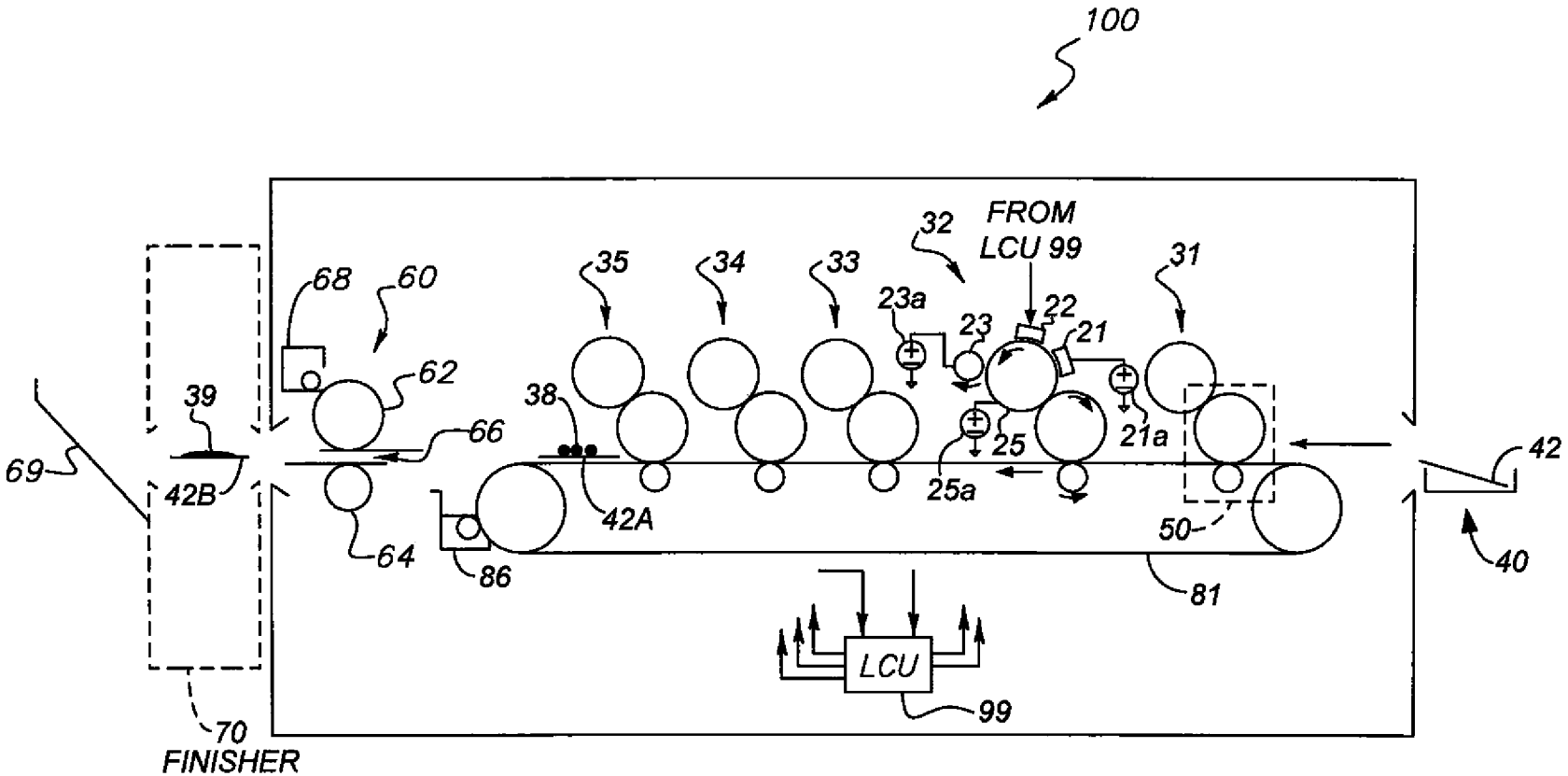
FIG. 1 is an elevational cross-section of an electrophotographic reproduction apparatus suitable for use with this invention.

The attached drawings are for purposes of illustration and are not necessarily to scale.

DETAILED DESCRIPTION OF THE INVENTION

The electrophotographic process can be embodied in devices including printers, copiers, scanners, and facsimiles, and analog or digital devices, all of which are referred to herein as "printers." Various aspects of the present invention are useful with electrostatographic printers such as electrophotographic printers that employ toner developed on an electrophotographic receiver, and ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g. a UV coating system, a glosser system, or a laminator system). A printer can reproduce pleasing black-and-white or color onto a receiver. A printer can also produce selected patterns of toner on a receiver, which patterns (e.g. surface textures) do not correspond directly to a visible image. The DFE receives input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, paper type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

In an embodiment of an electrophotographic modular printing machine useful with the present invention, e.g. the NEXPRESS 2100 printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g. dyes or pigments, which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. The provision of a clear-toner overcoat to a color print is desirable for providing protection of the print from fingerprints and reducing certain visual artifacts. Clear toner uses particles that are similar to the toner particles of the color development stations but without colored material (e.g. dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

FIG. 1 is an elevational cross-section showing portions of a typical electrophotographic printer 100 useful with the present invention. Printer 100 is adapted to produce images, such as single-color (monochrome), CMYK, or pentachrome (five-color) images, on a receiver (multicolor images are also known as "multi-component" images). Images can include text, graphics, photos, and other types of visual content. One embodiment of the invention involves printing using an electrophotographic print engine having five sets of single-color image-producing or -printing stations or modules arranged in tandem, but more or less than five colors can be combined on a single receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module 31, 32, 33, 34, 35 produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver, or from an imaging roller to one or more transfer roller(s) or belt(s) in sequence in transfer subsystem 50, and thence to receiver 42. Receiver 42 is, for example, a selected section of a web of, or a cut sheet of, planar media such as paper or transparency film.

Each receiver 42, during a single pass through the five modules 31, 32, 33, 34, 35, can have transferred in registration thereto up to five single-color toner images to form a pentachrome image. As used herein, the term "pentachrome" implies that in a print image, combinations of various of the five colors are combined to form other colors on the receiver 42 at various locations on the receiver 42, and that all five colors participate to form process colors in at least some of the subsets. That is, each of the five colors of toner can be combined with toner of one or more of the other colors at a particular location on the receiver to form a color different than the colors of the toners combined at that location. In an embodiment, printing module 31 forms black (K) print images, 32 forms yellow (Y) print images, 33 forms magenta (M) print images, and 34 forms cyan (C) print images.

Printing module 35 can form a red, blue, green, or other fifth print image, including an image formed from a clear toner (i.e. one lacking pigment). The four subtractive primary colors, cyan, magenta, yellow, and black, can be combined in various combinations of subsets thereof to form a representative spectrum of colors. The color gamut or range of a printer is dependent upon the materials used and process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g. metallic, fluorescent, or pearlescent colors), or a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Receiver 42A is shown after passing through printing module 35. Print image 38 on receiver 42A includes unfused toner particles.

Subsequent to transfer of the respective print images, overlaid in registration, one from each of the respective printing modules 31, 32, 33, 34, 35, receiver 42A is advanced to a fuser 60, i.e. a fusing or fixing assembly, to fuse print image 38 to receiver 42A. Transport web 81 transports the print-image-carrying receivers 42A to fuser 60, which fixes the toner particles to the respective receivers 42A by the application of heat and pressure. The receivers 42A are serially de-tacked from transport web 81 to permit them to feed cleanly into fuser 60. Transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along transport web 81 before or after cleaning station 86 in the direction of rotation of transport web 81.

Fuser 60 includes a heated fusing roller 62 and an opposing pressure roller 64 that form a fusing nip 66 therebetween. In an embodiment, fuser 60 also includes a release fluid application substation 68 that applies release fluid, e.g. silicone oil, to fusing roller 62. Alternatively, wax-containing toner can be used without applying release fluid to fusing roller 62. Other embodiments of fusers, both contact and non-contact, can be employed. For example, solvent fixing uses solvents to soften the toner particles so they bond with the receiver. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receivers (primarily), thereby causing the toner particles to melt by heat conduction, so that the toner is fixed to the receiver.

The receivers (e.g. receiver 42B) carrying the fused image (e.g., fused image 39) are transported in a series from the fuser 60 along a path either to a remote output tray 69, or back to printing modules 31, 32, 33, 34, 35 to create an image on the backside of the receiver 42B, i.e. to form a duplex print. Receivers 42B can also be transported to any suitable output accessory. For example, an auxiliary fuser or glossing assembly can provide a clear-toner overcoat. Printer 100 can also include multiple fusers 60 to support applications such as overprinting, as known in the art.

In various embodiments, between fuser 60 and output tray 69, receiver 42B passes through finisher 70. Finisher 70 performs various paper-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers. This permits printer 100 to print on receivers 42 of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Each printing module 31, 32, 33, 34, 35 includes various components. For clarity, these are only shown in printing module 32.

Photoreceptor 25 includes a photoconductive layer formed on an electrically conductive substrate. The photoconductive layer is an insulator in the substantial absence of light so that electric charges are retained on its surface. Upon exposure to light, the charge is dissipated. In various embodiments, photoreceptor 25 is part of, or disposed over, the surface of an imaging member, which can be a plate, drum, or belt. Photoreceptors can include a homogeneous layer of a single material such as vitreous selenium or a composite layer containing a photoconductor and another material. Photoreceptors can also contain multiple layers.

Around photoreceptor 25 are arranged, ordered by the direction of rotation of photoreceptor 25, charger 21, exposure subsystem 22, and toning station 23. Transfer subsystem 50 transfers the visible image from photoreceptor 25 after toning station 23 to a receiver 42 moving through transfer subsystem 50.

As described above, charger 21 produces a uniform electrostatic charge on photoreceptor 25 or its surface. In an embodiment, charger 21 is a corona charger including a grid between the corona wires (not shown) and photoreceptor 25. Voltage source 21 a applies a voltage to the grid to control charging of photoreceptor 25.

Exposure subsystem 22 selectively image-wise discharges photoreceptor 25 to produce a latent image. In embodiments using laser devices, a rotating polygon (not shown) is used to scan one or more laser beam(s) across the photoreceptor 25 in the fast-scan direction. One dot site is exposed at a time, and the intensity or duty cycle of the laser beam is varied at each dot site. In embodiments using an LED array, the array can include a plurality of LEDs arranged next to each other in a line, all dot sites in one row of dot sites on the photoreceptor 25 can be selectively exposed simultaneously, and the intensity or duty cycle of each LED can be varied within a line exposure time to expose each dot site in the row during that line exposure time.

As used herein, an "engine pixel" is the smallest addressable unit on photoreceptor 25 or receiver 42 (FIG. 1) which the light source (e.g., laser or LED) can expose with a selected exposure different from the exposure of another engine pixel. Engine pixels can overlap, e.g., to increase addressability in the slow-scan direction (S). Each engine pixel has a corresponding engine pixel location, and the exposure applied to the engine pixel location is described by an engine pixel level.

Toning station 23 (also called a development station in the art) applies toner to the photoreceptor 25 to develop the latent image into a visible image. Toner can be applied to either the charged or discharged parts of the latent image. Toning station 23 includes a developer supply and a toning member. Developer is provided to the toning member by the supply, which can include a supply roller, auger, or belt. Toner is transferred by electrostatic forces from the toning member to photoreceptor 25. These forces can include Coulombic forces between charged toner particles and the charged electrostatic latent image, and Lorentz forces on the charged toner particles due to the electric field produced by bias voltages on the components of the system.

The toning member can include a rotating or stationary toning shell for transporting toner, and optionally a rotating or stationary magnetic core inside the toning shell for drawing developer to the toning shell. One-component or two-component developers can be used with the toning member. The magnetic core can include one magnet or a plurality of magnets, and, if rotating, can rotate at a speed or in a direction the same as, or different from, the speed or direction of the toning shell. A magnetic core (not shown) preferably provides a magnetic field of varying magnitude and direction around the outer circumference of photoreceptor 25. Further details of magnetic cores can be found in U.S. Pat. No. 7,120,379 to Eck et al., issued Oct. 10, 2006, and in U.S. Publication No. 20020168200 to Stelter et al., published Nov. 14, 2002, the disclosures of which are incorporated herein by reference.

In an embodiment, a voltage bias is applied to toning station 23 by voltage source 23*a* to control the electric field, and thus the rate of toner transfer, from toning station 23 to photoreceptor 25. In an embodiment, a voltage is applied to a conductive base layer of photoreceptor 25 by voltage source 25*a* before development, that is, before toner is applied to photoreceptor 25 by toning station 23. The applied voltage can be zero; the base layer can be grounded. This also provides control over the rate of toner deposition during development. In an embodiment, the exposure applied by exposure subsystem 22 to photoreceptor 25 is controlled by LCU 99 to produce a latent image corresponding to the desired print image 38. Exposure subsystem 22 can include one or more LEDs, or a laser and a raster optical scanner (ROS). All of these parameters can be changed to adjust the operation of printer 100.

Further details regarding printer 100 are provided in U.S. Pat. No. 6,608,641, issued on Aug. 19, 2003, to Peter S. Alexandrovich et al., and in U.S. Publication No. 2006/0133870, published on Jun. 22, 2006, by Yee S. Ng et al., the disclosures of which are incorporated herein by reference.

Figure 2:
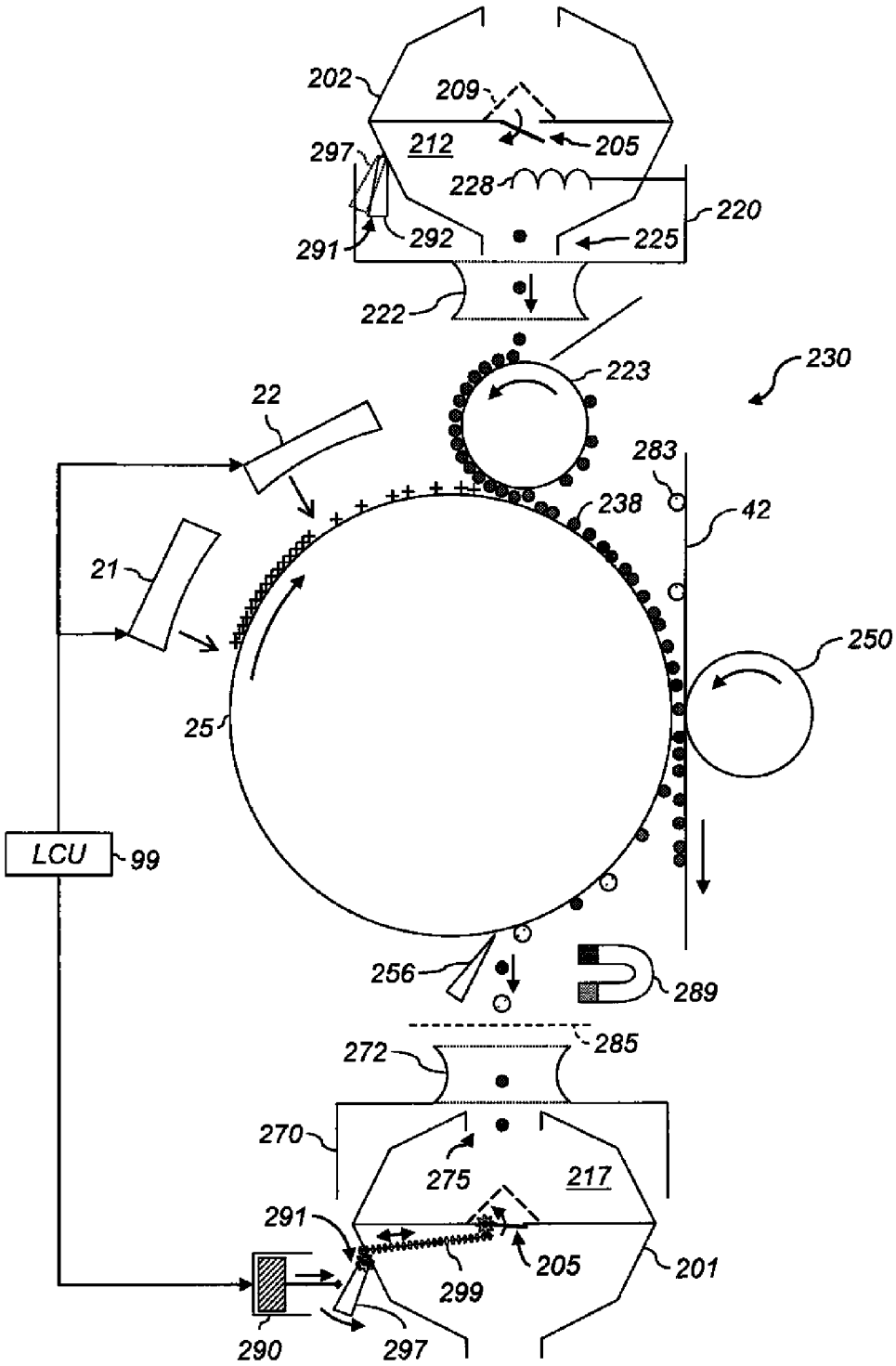
FIG. 2 is an elevational cross-section of portions of a dry electrophotographic (EP) printing apparatus according to various embodiments.

FIG. 2 is an elevational cross-section of portions of a dry electrophotographic (EP) printing apparatus according to various embodiments. LCU 99, charger 21, exposure subsystem 22, and photoreceptor 25 are as shown in FIG. 1.

First toner bottle 201 receives waste toner and second toner bottle 202 supplies fresh toner. Toner bottles 201, 202 are interchangeable, as described below. Each toner bottle 201, 202 includes supply volume 212 and waste volume 217. Supply volume 212 and waste volume 217 are separated by separator 205 that permits toner to pass from waste volume 217 to supply volume 212 below it. In various embodiments, separator 205 prevents toner from passing from supply volume 212 to waste volume 217. Each toner bottle 201, 202 also includes status recorder 291 adapted to retain state information about the respective toner bottle 201, 202. Status recorder 291 has waste and supply states. When status recorder 291 is in the waste state, the corresponding toner bottle (e.g., 201 or 202) is ready to be used to collect waste. When status recorder 291 is in the supply state, the corresponding toner bottle (e.g. 201, 202) is ready to supply fresh toner for printing. In this example, status recorder 291 of first toner bottle 201 is in waste state 297. Status recorder 291 of second toner bottle 202 is in supply state 292. Waste state 297 is shown dotted on second toner bottle 202 for comparison and is discussed below.

Waste receptacle 270 is adapted to receive first toner bottle 201 in waste state 297 of corresponding status recorder 291. Supply receptacle 220 is adapted to receive second toner bottle 202 only in supply state 292 of second toner bottle 202.

Printing module 230 produces toner print images on receiver 42. Printing module 230 includes one or more imaging members. In this example, printing module 230 includes toning drum 223 and photoreceptor 25, which are both imaging members. Printing module 230 also includes transfer backup roller 250. At least one of the imaging members, here, toning drum 223, is adapted to receive dry toner from supply volume 212 of second toner bottle 202 in supply receptacle 220. At least one of the imaging members, here, photoreceptor 25, is adapted to apply dry toner to receiver 42 to form a print image.

Printing module 230 also includes cleaning device 256 for removing toner from at least one of the imaging members, here photoreceptor 25. Cleaning device 256 is shown as a blade, but can also include a flexible wiper, a roller, a fur brush, or a vacuum. Cleaning device 256 transports the removed toner to waste volume 217 of first toner bottle 201 in waste receptacle 270. Cleaning device 256 can actively transport removed toner, or can passively transport it, e.g., by permitting it to fall under the influence of gravity.

Toggle 290 changes the state of status recorder 291 of first toner bottle 201 in waste receptacle 270 to the supply state. As a result, waste toner in waste volume 217 of first toner bottle 201 is made available to be used as supply toner in supply receptacle 220 when first toner bottle 201 is installed in supply receptacle 220 instead of second toner bottle 202. In the example shown here, toggle 290 is a piston controlled by LCU 99. Toggle 290 pushes status recorder 291 from waste state 297 to supply state 292.

In these embodiments, waste toner is collected in waste volume 217 of first toner bottle 201. When supply volume 212 of second toner bottle 202 is empty, first toner bottle 201 is installed in supply receptacle 220. Waste toner passes through separator 205 into supply volume 212 and is re-used in the printer. This provides re-use of toner without requiring outside toner recycling, reducing waste and complexity. Status recorder 291 prevents a bottle intended for use as a waste bottle (e.g., one empty of toner) from being used in supply receptacle 220. In the example shown, status recorder 291 in waste state 297 (dotted lines) mechanically interferes with supply receptacle 220. As a result, toner bottle 201 cannot be inserted in supply receptacle 220 if it is in waste state 297. In various embodiments, toner bottles 201, 202 include gates (not shown) on waste ingress 275 or supply egress 225 that are normally closed. The appropriate gate opens when the toner bottle is fully inserted into supply receptacle 220 or waste receptacle 270. The gates can be self-closing seals, such as elastomeric membranes with one or more slits cut in them. The gates can also include iris apertures, sliding sheet covers, or pivoting covers driven by locator pins on the receptacle that engage with linkages on the toner bottle.

In various embodiments, status recorder 291 is electrical, mechanical, electromechanical, or chemical. For example, status recorder 291 can include a shape-memory alloy, a pivoting beam, a nonvolatile memory, a bistable mechanical element, such as a beam with detents for preferred positions, driven by a solenoid, or a patch of chemical whose optical density can be changed chemically, optically, or electronically between two stable values. Status recorder 291 can also be a sliding tab (e.g., similar to the read-only tab on a 3.5" floppy disk) or a breakable or bendable member such as the read-only tab on a cassette tape. Toggle 290 can change the state of status recorder 291 on a toner bottle while that toner bottle is in waste receptacle 270, on insertion of the bottle into waste receptacle 270, or on removal of the bottle from waste receptacle 270.

In various embodiments, each toner bottle 201, 202 includes respective supply egress 225 that permits toner to pass out of respective supply volume 212. Each toner bottle 201, 202 also includes respective waste ingress 275 for receiving toner into respective waste volume 217.

Waste receptacle 270 includes waste coupling 272 for selectively permitting toner to be deposited through waste ingress 275 of first toner bottle 201. Waste coupling 272 can be an opening, e.g., a toroidal or rectangular opening, or a chute. Toner is deposited through waste ingress 275 when first toner bottle 201 is in waste state 297. In various embodiments, the printer includes an interlock (not shown) that prevents toner from being deposited through waste ingress 275, or prevents the printer from operating, if first toner bottle 201 is in the supply state. In an example, status recorder 291 in supply state 292 interferes mechanically with a door controlling access to waste receptacle 270, and a sensor on the door is connected to LCU 99 so that if the door is not fully closed, LCU 99 will not operate the printer. This advantageously reduces the probability of depositing waste toner into a full fresh-toner bottle.

Supply receptacle 220 includes supply coupling 222 for selectively permitting toner to be withdrawn through supply egress 225 of second toner bottle 202 when second toner bottle 202 is in supply state 292. The printer can include an interlock as discussed above so that the printer will not operate, or toner will not be withdrawn through supply egress 225, if toner bottle 202 is in waste state 297.

In these embodiments, at least one of the imaging members, e.g. toning drum 223, is adapted to receive toner through supply coupling 222. Cleaning device 256 transports the removed toner to waste coupling 272 actively or passively (including by gravity).

In addition to toner particles 238, contaminant particles 283 can remain adhered to the photoreceptor 25 after transfer of toner to receiver 42 to form the print image. Contaminant particles can include paper fibers, magnetic carrier particles, dust, foam particles rubbed off of rollers, and aerosol oil drops. In various embodiments, each toner bottle 201, 202 further includes filter 209 that retains contaminant particles of selected sizes in the corresponding waste volume 217. That is, filter 209 blocks the transport of contaminant particles 283 from waste volume 217 into supply volume 212. For example, filter 209 can retain particles greater than a selected threshold (e.g., >20 μm). In an example, toner particles are 6 μm-9 μm in diameter. Magnetic carrier particles are 15 μm-35 μm, or up to 200 μm in diameter (volume-weighted median diameter, as determined by a device such as a Coulter Multisizer). Contaminant particles 283 are >20 μm in diameter or, for fibers, the direction the fiber extends. Contaminant fibers can be 1 -2 μm in diameter. Contaminant fiber lengths can be large enough to be visible to the naked eye.

In various embodiments, waste receptacle 270 further includes contaminant filter 285 that prevents contaminant particles of selected sizes from entering waste volume 217 of toner bottle 201 in waste receptacle 270. This leaves more room for toner in waste volume 217.

In various embodiments, toner flows at a controlled rate from waste volume 217 to supply volume 212. Specifically, separator 205 in each toner bottle 201, 202 permits a selected amount of toner to pass from the corresponding waste volume 217 to the corresponding supply volume 212 per unit time. This is similar to a calibrated leak from a fluid vessel, or to the flow of sand in an hourglass.

In various embodiments, each toner bottle 201, 202 includes a structure for preventing the passage of toner through the corresponding separator 205 when the corresponding status recorder 291 is in waste state 297. In the example shown, interlock 299 is a mechanical interlock that closes the gate on separator 205 when status recorder 291 is in waste state 297. Interlock 299 includes a rack driven by a pinion on status recorder 291. When status recorder 291 rotates clockwise from supply state 292 to waste state 297, the pinion pushes the rack to the right, towards separator 205. That rotates the pinion on separator 205 counter-clockwise, closing the gate. When toggle 290 pushes status indicator counter-clockwise to supply state 292, the rack moves left, the pinion on separator 205 turns clockwise, and the gate opens. Interlock 299 can also include a motor or servo driving a gate, controlled by a sensor on status recorder 291. In embodiments using an electronic status recorder 291, the servo can be driven based on the electronic status.

In various embodiments, the capacity of each waste volume 217 is greater than six percent of the capacity of the corresponding supply volume 212. Approximately five percent of the fresh toner used can become waste toner, and the waste volume 217 in these embodiments has the capacity to hold this amount. Consequently, the waste from a single bottle of fresh toner can be contained in that bottle.

In various embodiments, the printer includes blender 228 for mixing waste toner and fresh toner in supply volume 212 of toner bottle 202 in supply receptacle 220. Blender 228 can include components attached to the printer or to supply receptacle 220, components attached to toner bottle 202, or both. Blender 228 can be a spiral wire blender, a ribbon blender, or one or more rotating paddles.

In various embodiments, the printer includes magnet 289 for deflecting magnetic carrier particles away from the waste receptacle. In printers using two-component developers (toner+carrier), carrier particles can become stuck to photoreceptor 25, a phenomenon referred to as "developer pick-up" or "DPU". Magnet 289, which can be permanent or an electromagnet, can attract or repel magnetic carrier particles. This motion moves the carrier particles out of the stream of particles passing through waste ingress 275, reducing the collection of DPU in waste volume 217.

Figure 3:
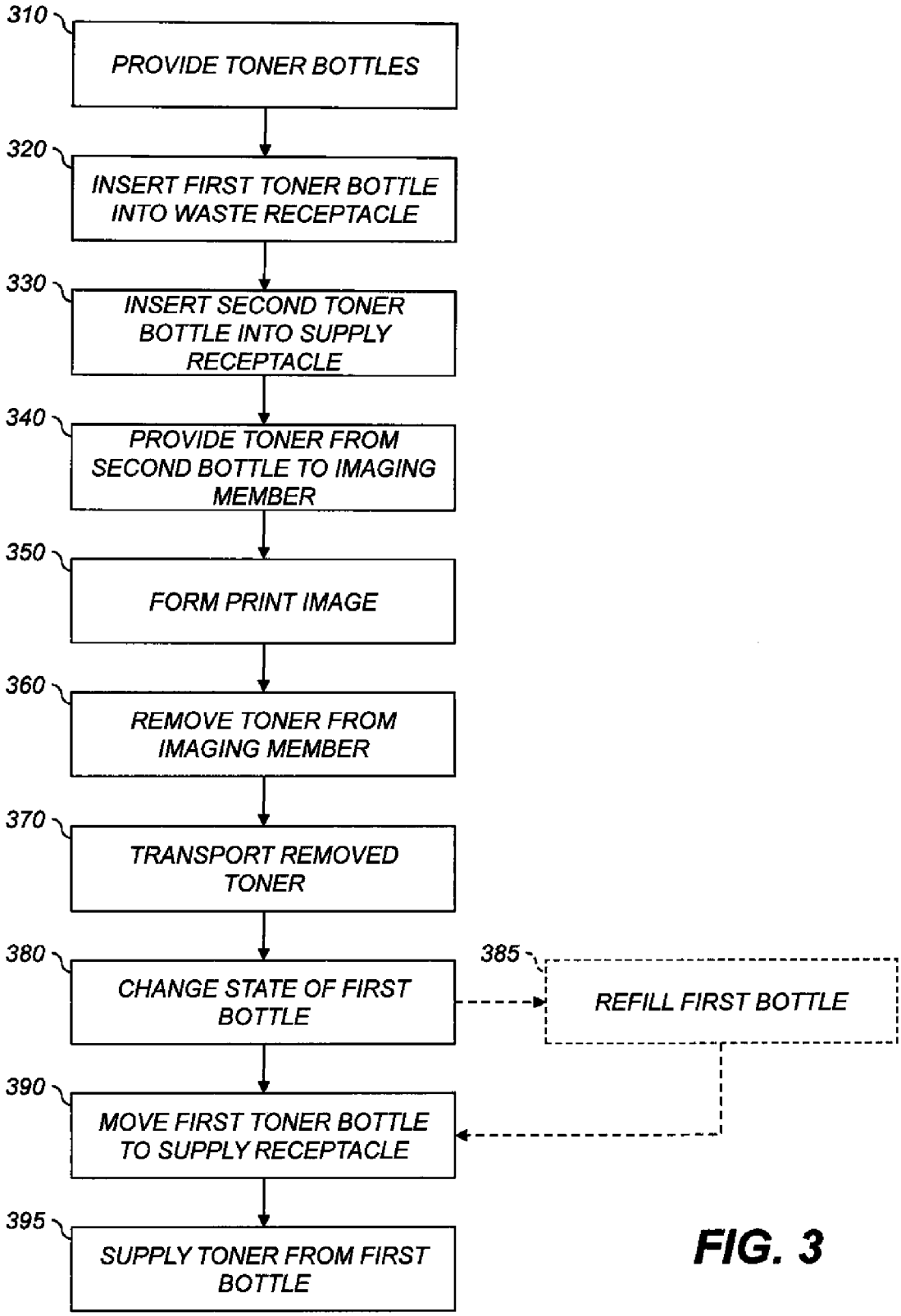
FIG. 3 is a flowchart of methods of re-using waste toner in a dry EP printer according to various embodiments.

FIG. 3 is a flowchart of methods of re-using waste toner in a dry EP printer according to various embodiments. Processing begins with step 310.

In step 310, first and second toner bottles are provided. Each toner bottle includes a supply volume and a waste volume separated by a separator that permits toner to pass from the waste volume to the supply volume, e.g., as described above. Each toner bottle also includes a status recorder adapted to retain state information about the toner bottle, the status recorder having waste and supply states, as described above. In this step, the first toner bottle is in the waste state and the second toner bottle is in the supply state. Step 310 is followed by step 320.

In step 320, the first toner bottle is inserted into a waste receptacle. Step 320 is followed by step 330.

In step 330, the second toner bottle is inserted into a supply receptacle. Step 330 is followed by step 340.

In step 340, toner is provided to an imaging member in the printer from the supply volume of the second toner bottle in the supply receptacle. Step 340 is followed by step 350.

In step 350, the provided toner is applied to a receiver to form a print image. Step 350 is followed by step 360.

In step 360, waste toner is removed from at least one imaging member in the printer. Step 360 is followed by step 370.

In step 370, the removed toner is transported to the waste volume of the first toner bottle in the waste receptacle. Step 370 is followed by step 380.

In step 380, the state of the status recorder of the first toner bottle in the waste receptacle is changed to the supply state. Step 380 is followed by optional step 385 and by step 390.

In optional step 385, the supply volume of the first toner bottle is refilled. This is performed after transporting the removed toner to the waste volume and before moving the first toner bottle to the supply receptacle. Step 385 is followed by step 390.

In step 390, the first toner bottle is moved to the supply receptacle. Step 390 is followed by step 395.

In step 395, the waste toner in the waste volume of the first toner bottle is supplied to the printer from the supply receptacle.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

Parts List

21 charger
21*a* voltage supply
22 exposure subsystem
23 toning station
23*a* voltage source
25 photoreceptor
25*a* voltage source
31, 32, 33, 34, 35 printing module
38 print image
39 fused image
40 supply unit
42, 42A, 42B receiver
50 transfer subsystem

60 fuser
62 fusing roller
64 pressure roller
66 fusing nip
68 release fluid application substation
69 output tray
70 finisher
81 transport web
86 cleaning station
99 logic and control unit (LCU)
100 printer
201, 202 toner bottle
205 separator
209 filter
212 supply volume
217 waste volume
220 supply receptacle
222 supply coupling
223 toning drum
225 supply egress
228 blender
230 printing module
238 toner particle
250 transfer backup roller
256 cleaning device
270 waste receptacle
272 waste coupling
275 waste ingress
283 contaminant particle
285 contaminant filter
289 magnet
290 toggle
291 status recorder
292 supply state of status recorder
297 waste state of status recorder
299 interlock
310 provide toner bottles step
320 insert first toner bottle into waste receptacle step
330 insert second toner bottle into supply receptacle step
340 receive toner from second bottle step
350 form print image step
360 remove toner from imaging member step
370 transport removed toner step
380 change state of first bottle step
385 refill first bottle step
390 move first toner bottle to supply receptacle step
395 supply toner from first bottle step

The invention claimed is:

1. Dry electrophotographic (EP) printing apparatus, comprising:

a) first and second toner bottles, each including:

i) a supply volume and a waste volume separated by a separator that permits toner to pass from the waste volume to the supply volume; and ii) a status recorder adapted to retain state information about the respective toner bottle, the status recorder having waste and supply states;

b) a waste receptacle adapted to receive the first toner bottle in the waste state;

c) a supply receptacle adapted to receive the second toner bottle only in the supply state;

d) a printing module including:

i) one or more imaging members, wherein at least one of the imaging members is adapted to receive dry toner from the supply volume of the second toner bottle in the supply receptacle, and at least one of the imaging members is adapted to apply dry toner to a receiver to form a print image; and ii) a cleaning device for removing toner from at least one of the imaging members and transporting the removed toner to the waste volume of the first toner bottle in the waste receptacle; and e) a toggle for changing the state of the status recorder of the first toner bottle in the waste receptacle to the supply state, so that the waste toner in the waste volume of the first toner bottle is made available to be used as supply toner in the supply receptacle.

2. The apparatus according to claim 1, wherein each toner bottle further includes a filter that retains contaminant particles of selected sizes in the corresponding waste volume.

3. The apparatus according to claim 1, wherein the waste receptacle further includes a contaminant filter that prevents contaminant particles of selected sizes from entering the waste volume of the toner bottle in the waste receptacle.

4. The apparatus according to claim 1, wherein each separator permits a selected amount of toner to pass from the corresponding waste volume to the corresponding supply volume per unit time.

5. The apparatus according to claim 1, wherein each toner bottle further including means for preventing the passage of toner through the corresponding separator when the corresponding status recorder is in the waste state.

6. The apparatus according to claim 1, wherein the capacity of each waste volume is greater than 6% of the capacity of the corresponding supply volume.

7. The apparatus according to claim 1, further including a blender for mixing waste toner and fresh toner in the supply volume of the toner bottle in the supply receptacle.

8. The apparatus according to claim 1, further including a magnet for deflecting magnetic carrier particles away from the waste receptacle.

9. A method of re-using waste toner in a dry EP printer, comprising:

providing first and second toner bottles, each including:

a supply volume and a waste volume separated by a separator that permits toner to pass from the waste volume to the supply volume; and a status recorder adapted to retain state information about the respective toner bottle, the status recorder having waste and supply states;

wherein the first toner bottle is in the waste state and the second toner bottle is in the supply state;

inserting the first toner bottle in a waste receptacle;

inserting the second toner bottle in a supply receptacle;

providing toner from the supply volume of the second toner bottle in the supply receptacle to an imaging member in the printer, and applying the toner to a receiver to form a print image;

removing toner from at least one imaging member in the printer and transporting the removed toner to the waste volume of the first toner bottle in the waste receptacle;

changing the state of the status recorder of the first toner bottle in the waste receptacle to the supply state, and moving the first toner bottle to the supply receptacle, so that the waste toner in the waste volume of the first toner bottle is supplied to the printer from the supply receptacle.

10. The method according to claim 9, further including refilling the supply volume of the first toner bottle after transporting the removed toner to the waste volume and before moving the first toner bottle to the supply receptacle.

* * * * *